United States Patent [19]

White

[11] 3,977,445

[45] Aug. 31, 1976

[54] ASCEPTIC FILLING APPARATUS AND METHOD

[75] Inventor: Timothy P. White, Alexandria, Va.

[73] Assignee: Nobel Scientific Industries, Inc., College Park, Md.

[22] Filed: Mar. 4, 1975

[21] Appl. No.: 555,181

Related U.S. Application Data

[63] Continuation of Ser. No. 356,430, May 2, 1973, abandoned.

[52] U.S. Cl. ..... 141/5

[51] Int. Cl.[2] ..... B65B 31/02

[58] Field of Search ..... 53/88; 98/36; 99/474; 137/237, 238, 240; 141/1, 4, 5, 11, 46–49, 63, 64, 69, 70, 85, 89–93, 100, 286

[56] References Cited

UNITED STATES PATENTS

| | | | |
|---|---|---|---|
| 2,357,013 | 8/1944 | McKinnis | 141/70 |
| 2,854,039 | 9/1958 | Boyd et al. | 141/70 |
| 3,044,500 | 7/1962 | Crisafi | 141/85 |
| 3,556,174 | 1/1971 | Gibble et al. | 141/69 |

*Primary Examiner*—Richard E. Aegerter
*Assistant Examiner*—Frederick R. Schmidt
*Attorney, Agent, or Firm*—Rose & Edell

[57] ABSTRACT

A compact device and method for asceptically filling containers eliminates the need for clean work stations. A small enclosure has an outlet opening adapted to fit over and surround the neck of a pre-sterilized bottle. Sterile pressurized gas is introduced into the enclosure which is contoured to force the gas to flow at high velocity through the outlet opening, thereby causing the gas to flow into the bottle and to form a curtain of sterile high velocity gas which surrounds the bottle neck and prevents entry of ambient air. While the gas continues to flow, the bottle is filled with sterile media which passes through enclosure and displaces sterile gas in the bottle while being protected from contamination by the sterile flowing curtain.

8 Claims, 1 Drawing Figure

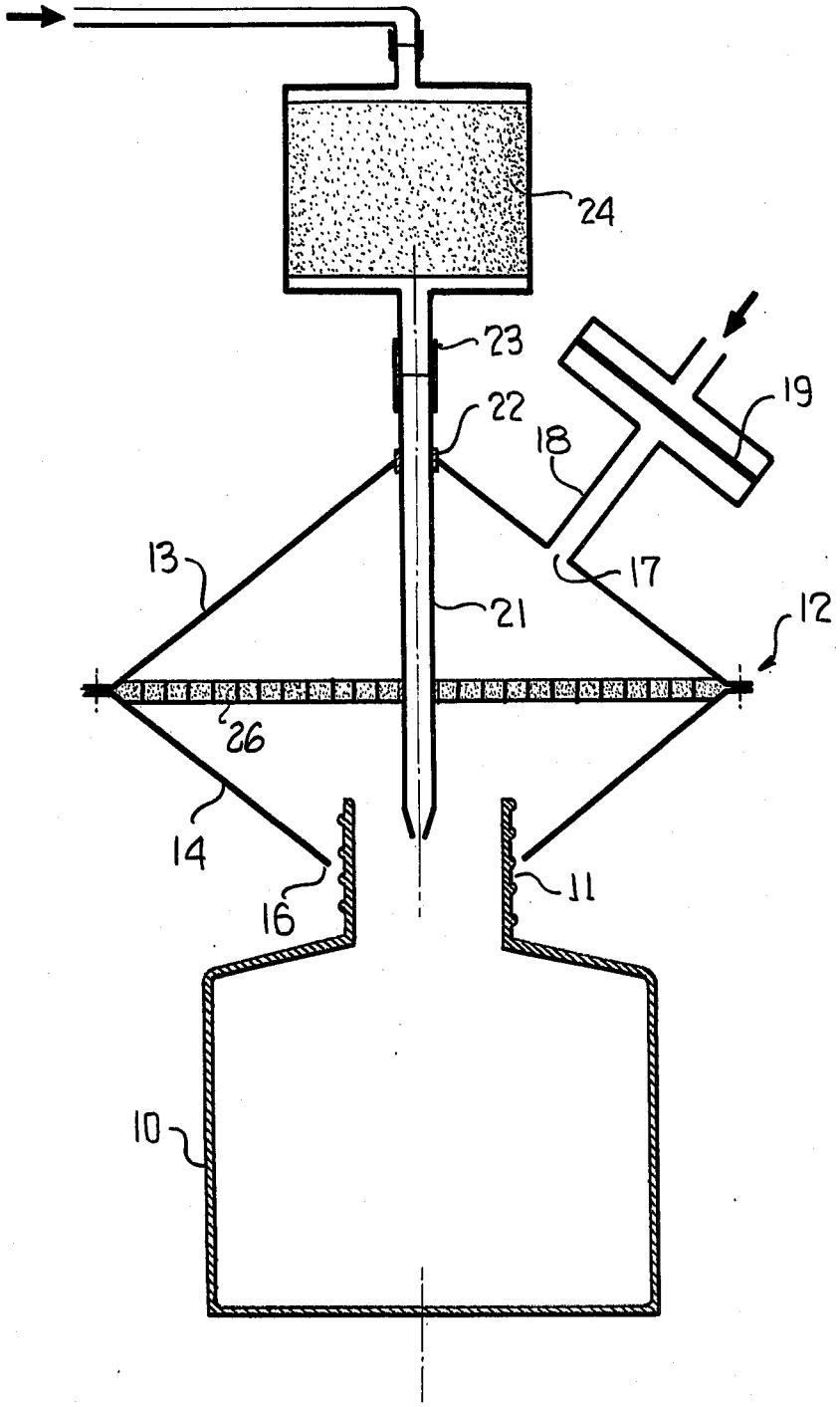
24
23
22
19
18
17
13
21
12
26
14
16
11
10

ASCEPTIC FILLING APPARATUS AND METHOD

This is a continuation of application Ser. No. 356;430, filed May 2, 1973 now abandoned.

BACKGROUND OF THE INVENTION

The present invention relates to a simplified and inexpensive approach to asceptically filling containers.

There are two generally accepted approaches to packaging sterile media in containers. The first and simplest involves filling a non-sterile container with a non-sterile medium and then autoclaving the filled container. The approach is only suitable where the filling medium is heat stable and the container can withstand the heat and pressures involved. The second approach is used where the filling medium is heat labile and/or the container cannot withstand autoclaving. Under such circumstances the container can be pre-sterilized chemically and the filling medium can be sterile filtered into the container under clean room conditions. It is this latter approach with which the present invention is concerned. More specifically, it is an object of the present invention to provide a method and apparatus for asceptically filling pre-sterilized containers without requiring clean room conditions.

There are commercially available a variety of clean work station units in which asceptic filling can be effected. Such units provide work stations through which filtered air is forced to flow in laminar state and at sufficient velocity through the station to prevent contaminated outside air from entering the work platform area. These stations are widely used but suffer from the disadvantages of high cost, virtual immobility, and a limited storage and work area. It is therefore another object of the present invention to provide a method and apparatus for filling pre-sterilized containers which is inexpensive, portable and permits virtually unlimited storage and work area. It is a more specific object of the present invention to provide an efficient method and apparatus for asceptically filling pre-sterilized containers in an ambient environment which does not require sterilization, the maintenance of clean room conditions, or a clean work station.

There is also commercially available an asceptic filling funnel which permits sterile filling media to displace sterile gas previously placed in the container. As the gas is displaced it is directed to provide a protective shield around the container, thereby keeping contaminants out of the container. However, after the container has been filled the shield provided by the sterile gas is dissipated, an abrupt pressure differential is often created which tends to suck in surrounding air. If the funnel is used in a clean work station the surrounding air causes little contamination; in a general work area, however, the result is a high incidence of contamination.

It is therefore a further object of the present invention to provide a method and portable apparatus for asceptically filling pre-sterilized containers in an untreated environment.

SUMMARY OF THE INVENTION

According to the present invention the filling inlet of a pre-sterilized container is inserted through an outlet opening of a portable enclosure. Sterile gas under pressure is admitted into the enclosure and is directed at relatively high velocity to flow through the enclosure outlet opening. In so doing the sterile gas forms a sterile flowing gas curtain which egresses from the outlet opening about the container periphery, thereby preventing contaminated ambient air from entering the enclosure and the container. Sterile filling media is then admitted to the container, through the enclosure, to displace the sterile gas in the enclosure. Importantly, the sterile gas flow is continued during the filling operation to maintain the sterile flowing curtain about container inlet.

BRIEF DESCRIPTION OF THE DRAWING

The above and still further objects, features and advantages of the present invention will become apparent upon consideration of the following detailed description of one specific embodiment thereof, especially when taken in conjunction with the following drawing, wherein:

The single FIGURE is a partially diagrammatic plan view in section of the portable apparatus employed in accordance with the present invention.

DESCRIPTION OF PREFERRED EMBODIMENT

Referring specifically to the drawing, a container to be filled is illustrated in the form of a bottle 10 having an upstanding neck 11 defining a passage through which flowing media may enter the bottle. The bottle 10 is illustrated in position to be filled with the aid of a filling device generally designated by the numeral 12. Filling device 12 is an enclosure defined by two generally conical sections 13, 14 positioned base-to-base. Bottom section 14 is truncated at its apex to provide a frusto-conical section with a generally circular, downwardly-directed outlet opening 16. Outlet opening 16 is sized to permit insertion of bottle neck 11 therethrough and to provide a small annular space between the enclosure outlet opening and bottle neck.

At least one gas inlet opening 17 is defined through the enclosure wall in upper section 13. Gas inlet opening 17 receives sterile gas under pressure from flow passage or tube 18 and delivers same into the enclosure. The sterile gas may, for example, be nitrogen delivered from a pressurized tank (not shown) and passsed to passage 18 via sterilizing filter 19.

A tube 21 protrudes through the top section 13 of the enclosure from exteriorly thereof. Pressure sealing means, such as O-ring 22, is provided at the point of entry of tube 21 into the enclosure. The outlet orifice of tube 21 is oriented to direct flowing media into bottle 10 when such media is delivered to the tube from exteriorly of enclosure 12. Tube 21 serves to conduct sterile media to fill bottle 10 and, in this regard, is illustrated as being connected via tube connector 23 to reagent filter 24. The flowing filling media is received under pressure from a source (not shown) and passed through filter 24 to tube 21.

A filter disk 26 extends across enclosure 12 along the the junction of the bases of the two sections 13 and 14. Tube 21 passes through disk 26 so that its outlet end is disposed to issue flowing media directly into bottle 10. Disk 26 is porous to the sterile gas delivered through gas inlet 17 and serves to diffuse the gas and cause it to flow evenly through the entire disk rather than be concentrated in a localized stream.

A typical filling operation employing the illustrated apparatus proceeds according to the following numbered steps:

1. The enclosure 12, filters 19 and 24 and the connecting tubing between these parts are sterilized in any suitable manner, such as by the ethylene oxide gas sterilization technique. The assembled parts are kept stored in a polyethylene bag until ready for use.
2. Bottle 10 and a cap (not illustrated) are also sterilized and kept stored in a polyethylene bag with cap intact until ready for use. An additional sterilized cap is also kept in sterile storage until ready for use.
3. A typical filling medium (for example a nutrient phosphate salt solution) is prepared and the pump is set up for pumping through reagent filter 24.
4. A nitrogen gas tank is connected to deliver nitrogen to filter 19. A suitable flow rate (typically 7.5 liters per minute) is adjusted and this gas flow is maintained.
5. The upstream side of reagent filter 24 is connected to a pumped or otherwise pressurized source of filling medium. Note: The subsequent steps of the filling operation are conducted in an open environment which needs no special cleaning or sterilization.
6. Bottle 10 is placed directly beneath enclosure 12 so that the gas flow through outlet opening 16 is toward the top the bottle cap. The cap (preloosened) is quickly twisted off (with two fingers) and the enclosure is lowered over neck 11 of bottle 10 so that reagent tube 21 protrudes slightly into the neck. The bottle is then filled. The additional sterile cap is removed from the polyethylene sleeve and quickly placed on the bottle, and the bottle is subsequently sealed with a polyseal.

In an actual test, 62 bottles were filled in an untreated environment in accordance with the listed steps. An additional 37 bottles were filled directly through a reagent filter without using enclosure 12 or the sterile gas supply. All filled bottles were then placed in an incubator in which the temperature was varied from 35°C to 39°C as measured periodically during each day. All bottles were inspected daily for 5 days. On the fifth day, none of the 62 asceptically filled bottles showed evidence of sedimentation or deterioration of any kind. Twenty-two of the 37 bottles which were filled without use of the device of the invention showed some degree of contamination in the form of sediment and/or visible mold growth. These 22 bottles were discarded. Eight of the asceptically filled bottles and two of the 15 remaining non-asceptically filled bottles were asceptically sampled and cultured. The results showed all 10 to be sterile.

It should be pointed out that the invention can be practiced with apparatus whose configuration varies from the specific configuration illustrated in the drawing. For example, disk 26 can be constructed to incorporate a sterilizing filter, thereby eliminating the need for gas filter 19 upstream of gas inlet 17. Likewise the two conical sections 13, 14 provide only one possible configuration for enclosure 12. In this regard, the illustrated configuration causes the gas to flow at relatively high velocity through the spaces between outlet opening 16 and the bottle neck 11. It is this high velocity sterile curtain which keeps contaminants out of bottle 10 during filling. Therefore, any enclosure configuration capable of creating relative high gas outflow around a container inlet would serve the principles of the present invention.

It is also possible to introduce the sterile gas into enclosure 12 at a plurality of locations. This would diffuse the gas sufficiently to permit elimination of disk 26.

Although nitrogen is mentioned as an example of a suitable sterile gas for use with the present invention, other gases are likewise suitable. For example, carbon dioxide or any other gas that will not react with the filling medium is suitable to serve the sterile gas function.

While I have described and illustrated one specific embodiment of my invention, it will be clear that variations of the details of construction which are specifically illustrated and described may be resorted to without departing from the true spirit and scope of the invention as defined in the appended claims.

What is claimed is:

1. A method of filling a container, having an open inlet at its upper end, with flowable sterile media wherein the filling employs apparatus including: an enclosure having a closed top and a lower end which includes an outlet opening of sufficient size to admit at least said upper end of said container into said enclosure in a filling position in which said outlet opening surrounds said upper end of said container with said outlet opening spaced from said container on all sides; inflow means for admitting pressurized sterile gas into said enclosure; and conduit means for said sterile flowable media extending into said enclosure from exteriorly thereof and supported by said enclosure, said conduit means being positioned to direct said sterile flowable media downwardly through said outlet opening and into the open upper end of said container; said method comprising the steps of:

pre-sterilizing said container;

surrounding the top and sides of said container inlet with the outlet opening of said enclosure;

admitting sterile gas into said enclosure through said inflow means and directing a stream of the sterile gas downwardly toward the open inlet of said container through said enclosure, said stream being sufficiently wide in cross-section when egressing through said outlet opening to surround said inlet on all sides and thereby provide a sterile flow which both enters said container through said open inlet and forms a downward flowing gas curtain which circumferentially surrounds the open inlet of said container and thereby prevents contaminants in the ambient environment from entering said container, said sterile gas being such as not to react with said sterile flowing media; and flowing said sterile media into said container inlet through said conduit means such that said flowing sterile media is surrounded by said stream of sterile gas while entering said container.

2. The method according to claim 1 further comprising the steps of diffusing said pressurized sterile gas inside said enclosure to cause evenly distributed gas flow in the direction of said outlet opening.

3. The method according to claim 2 wherein said step of diffusing utilizes a disk of material porous to said gas and extending across the entire enclosure at a location between said inflow means and said outlet spring.

4. The method according to claim 3 wherein said step of flowing utilizes a hollow tube extending through said enclosure and said disk toward said outlet opening.

5. The method according to claim 1 wherein said enclosure comprises upper and lower substantially conical sections positioned base-to-base, and wherein said outlet opening comprises a truncated apex portion of said lower conical section.

6. The method according to claim 5 wherein said inflow means is an inlet port defined through a wall in said upper conical section, said apparatus further comprising a disk porous to said gas extending entirely along the commonly positioned bases of said conical section.

7. The method according to claim 1 further comprising the step of sterilizing said gas before it flows through said outlet opening.

8. The method according to claim 1 further comprising the step of sterilizing said media prior to delivery through said conduit means.

* * * * *